US006469279B1

(12) United States Patent
Ohtsuka

(10) Patent No.: US 6,469,279 B1
(45) **Date of Patent: *Oct. 22, 2002**

(54) IMAGE HEATING APPARATUS AND HEATER

(75) Inventor: Yasumasa Ohtsuka, Toride (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/810,149

(22) Filed: Mar. 7, 1997

(30) Foreign Application Priority Data

Mar. 7, 1996 (JP) ..... 8-080931

(51) Int. Cl.[7] ..... H05B 1/00; H01C 1/012
(52) U.S. Cl. ..... 219/216; 338/307
(58) Field of Search ..... 219/216, 469, 219/470, 543; 338/307, 308, 309; 355/285, 289, 208

(56) References Cited

U.S. PATENT DOCUMENTS

| | | | | |
|---|---|---|---|---|
| 4,075,455 A | * | 2/1978 | Kitamura et al. | 219/216 |
| 4,367,037 A | * | 1/1983 | Nishikawa | 355/14 FU |
| 4,965,589 A | * | 10/1990 | Takeuchi | 219/216 |

(List continued on next page.)

FOREIGN PATENT DOCUMENTS

| | | |
|---|---|---|
| DE | 27 18 822 | 11/1978 |
| DE | 32 48 203 | 6/1984 |
| EP | 0 360 418 | 3/1990 |
| EP | 0 372 479 | 6/1990 |
| EP | 0 486 890 | 5/1992 |
| EP | 0 546 495 | 6/1993 |
| EP | 0 604 977 | 7/1994 |
| GB | 1 278 411 | 6/1972 |
| JP | 63-313182 | 12/1988 |
| JP | 1-263679 | 10/1989 |
| JP | 2-157878 | 6/1990 |
| JP | 3-226985 | 10/1991 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 04-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 5-273880 | 10/1993 |
| JP | 6-118817 | 4/1994 |
| JP | 6-274068 | 9/1994 |

OTHER PUBLICATIONS

U.S. application No. 08/521,062, Ohtsuka, filed Aug. 29, 1995.

*Primary Examiner*—Teresa Walberg
*Assistant Examiner*—Daniel Robinson
(74) *Attorney, Agent, or Firm*—Fitzpatrick, Cella, Harper & Scinto

(57) ABSTRACT

An image heating device includes a heater; a film having a surface in slidable contact with said heater and an opposite surface contactable to a recording material carrying an image; wherein the image on the recording material is heated by heat from said heater through said film; wherein said heater includes an elongated base material, a plurality of resistor extended in a longitudinal direction on said base material, and a temperature detecting element provided on said base material: wherein a resistance of a first portion of said resistor which is opposed to said temperature detecting element in the longitudinal direction of said resistor, has a resistance value higher than that in said second portion.

38 Claims, 11 Drawing Sheets

U.S. PATENT DOCUMENTS 5,021,867 A * 6/1991 Przybysz ..... 338/308
5,102,470 A * 4/1992 Kodato ..... 338/225
5,122,777 A * 6/1992 Shiratsuki ..... 338/306
5,162,634 A 11/1992 Kusaka et al.
5,241,155 A * 8/1993 Koh et al. ..... 219/216
5,304,784 A * 4/1994 Tagashira ..... 219/543
5,306,898 A 4/1994 Yukawa et al.
5,338,919 A 8/1994 Tagashira et al.
5,365,314 A 11/1994 Okuda et al.
5,376,773 A 12/1994 Masuda et al.
5,406,321 A * 4/1995 Schwiebert et al. ..... 347/102
5,444,521 A 8/1995 Tomoyuki et al.
5,464,964 A 11/1995 Okuda et al.
5,534,987 A * 7/1996 Ohtsuka ..... 219/216
5,592,276 A 1/1997 Ohtsuka et al.
5,681,494 A * 10/1997 Suzuki et al. ..... 219/497
5,724,628 A * 3/1998 Sano ..... 399/33
5,724,639 A * 3/1998 Tamura et al. ..... 399/333
5,778,293 A * 7/1998 Ohtsuka ..... 399/329
5,811,759 A * 9/1998 Kosagi et al. ..... 219/216

* cited by examiner

IMAGE HEATING APPARATUS AND HEATER

FIELD OF THE INVENTION AND RELATED ART

The present invention relates to an image heating apparatus used in an image forming apparatus such as a copying machine or a printer In particular, it relates to a heater used in the image forming apparatus.

In recent years, heating apparatuses based on a film heating system have been proposed, and some of them have been put to practical use (Japanese Laid-Open Patent Application Nos.: 313182/1988, 263679/1989, 157878/1990, 44075–44083/1992, and 204980–204984).

In these heating apparatuses, an object to be heated in pressed on a heating member, with interposition of a sheet of heat resistant film between the object and the heating member, and the heat from the heating member is applied to the object through the heat resistant film while moving the object and the heat resistant film relative to the heating member. Such heating apparatuses can be used as means for fixing an unfixed toner image to a sheet of recording material to produce a permanent toner image.

Also, they can be used in a wide range of heating apparatuses, for example, an apparatus for heating a sheet of recording material to improve its surface properties such as glossiness, an apparatus for temporarily fixing a toner image, or a means for simply heating a material in the form of a sheet.

In the case of a heating apparatus based on a film heating system, which uses a heater with low thermal capacity, and very thin film, the temperature of the heating member quickly increases, eliminating the need for supplying the heater with current while the apparatus is on standby. Therefore, even if a sheet of recording material as an object to be heated is fed without pre-activating the heater, the heater can reach a predetermined temperature, sufficiently before the sheet of recording material reaches a predetermined fixing temperature. Consequently, a heating apparatus based on a film heating system can save electrical power, can shorten waiting time (starts up quickly to afford an on-demand operation), and also can reduce the rate of increase in the internal temperature of the main assembly of an image forming apparatus or the like; it is very effective and offers many advantages.

FIG. 20(*a*) is an enlarged schematic cross-section of the essential portion of a typical heating apparatus (image fixing thermal apparatus) based on a film heating system, and FIG. 20(*b*) is a partially cutaway schematic plan of a heating member.

A reference numeral 10 designates a heating member, which comprises a heater substrate 2 (electrically insulative base member), a patterned heat generating resistor 3, a patterned electrically conductive material 4, a patterned electrically conductive material 4*a,* patterned power supply electrodes 5 and 6, a surface protection layer 7, a safety element 8, and the like. The heat generating resistor 3 is deposited in a predetermined pattern on one (front surface) of the surfaces of the heater substrate 2, and the surface protection layer 7 covers the patterned that generating resistor 3 and the patterned electrically conductive material 4. The safety element 8 comprises a thermal fuse, a thermal switch, and the like, and is placed in contact with the other surface (back surface) of the heater substrate 2.

The heater substrate 2 is a thin, rectangular member, measuring 240 mm in length, 10 mm in width, and 1 mm in thickness. Its longitudinal direction is perpendicular to a direction A in which a heat resistant film F and a recording material P as an object to be heated are conveyed. It is composed of ceramic material such as alumina or the like, being heat resistant, electrically insulative, and low in thermal capacity. The heat resistant film F will be described later.

The patterned heat generating member 3 is a narrow strip of electrically resistive material, which extends in the longitudinal direction of the ceramic substrate. It is created by coating paste of electrically resistive material such as silver/palladium (Ag/Pb) or Ta2N, on the ceramic substrate to a thickness of 10 $\mu$m and a width of 1–3 mm, and then baking it. The coating method is a screen printing method or the like.

The patterned electrically conductive material 4 is a narrow strip of electrically conductive material, which extends on the ceramic substrate also in the longitudinal direction of the ceramic substrate, that is, substantially parallel to the patterned heat generating resistor 3.

Two patterned power supply electrodes 5 and 6 are disposed in parallel at one longitudinal end of the surface of the ceramic substrate 2.

One end of the patterned heat generating resistor 3 is connected to the patterned power supply electrodes 5 by the patterned conductive material 4*a,* and the other is connected to the patterned power supply electrode 6 by the patterned conductive material 4.

The patterned conductive material 4, the patterned conductive material 4*a,* the patterned power supply electrode 5, and the patterned power supply electrode 6 are all created by coating paste which contains electrically conductive material such as Ag, on the surface of the ceramic substrate 2, in a predetermined pattern, and baking it. The coating method is a screen printing method or the like.

The patterned heat generating resistor 3 and the patterned conductive material 4, which are substantially parallel to each other, constitute a current path through which electrical current flows in the longitudinal direction of the ceramic substrate 2 between the patterned power supply electrodes 5 and 6 disposed at one ed of the ceramic substrate 2.

The heating member 10 is fixed to a rigid and heat resistant heating member holder (stay) 11 in such a manner that the surface with the patterned heat generating member 3 is downwardly exposed.

An alphabetic reference F designates a sheet of 40–100 $\mu$m thick heat resistant film such as polyimide film or the like, and a reference numeral 9 designates a pressing roller as a pressing member for pressing the film F on the surface protection layer 7 which constitutes the surface on which the film F slides.

The film F moves, being pressed on the heating member 10 by the pressing roller 9 and sliding on the surface of the heating member 10 (surface of the surface protection layer 7), in the direction indicated by an arrow mark, at a predetermined speed, as it is rotationally driven by the force from an unillustrated driving means, or by the pressing roller 9 which doubles as a driving means.

As electrical power is supplied to the patterned power supply electrodes 5 and 6 from an unillustrated power supply circuit, the patterned heat generating resistor 3 generates heat across its entire length, increasing the temperature of the heating member 10. The increased temperature of the heating member 10 is detected by an unillustrated temperature detecting element. The detected temperature is fed back to an unillustrated temperature control circuit to control the power supply to the patterned heat generating resistor 3, so that the temperature of the heating member 10 is kept at a predetermined level.

The heating member 10 and the pressing roller 9 forms a heating nip N (fixing nip or compressing nip), in which the film F is pinched. After the heating member 10 is heated to the predetermined temperature by supplying the patterned heat generating resistor 3 with power, and the film F is caused to slide on the heating member 10, the recording material P, that is, the object to be heated, on which a toner image is to be fixed, is introduced into the heating nip N, between the pressing roller 9, and the film F which is sliding on the heating member 10, so that the recording material P is conveyed through the heating nip N together with the film F. While the heating material P is passing through the heating nip N, the heat from the heating member 10 is transmitted to the recording material P through the heat resistant film F to thermally fix to the surface of recording material P, the unfixed visible image (toner image) carried on the recording material P After passing through the heating nip N, the recording material P is separated from the surface of the film F and is conveyed further.

The safety element 8 is disposed in contact with the back side of the heating member 10, that is, the back surface of the heater substrate 2, so that it is heated by the heat from the heating member 10. It plays a role in instantly cutting off the power supply to the heat generating resistor 3 so that the apparatus is prevented from smoking or catching fire due to the overheating of the heating member 10.

Thus, the thermal capacity of the safety element 8 disposed in contact with the back surface of the heating member 10 is rendered as small as possible. In spite of such a precaution, the thermal capacity of the safety element 8 sometimes becomes larger than that of the heating member holder 11. If this situation occurs, the temperature of the heating member 10, adjacent to the contact between the heating member 10 and the safety element 8, becomes lower than the temperature across the rest of the heating member 10. As a result, the fixing performance of the image heating apparatus is adversely affected. For example, an object to be heated is nonuniformly heated, or a time lag occurs as the safety element 8 responds to a heater control failure.

SUMMARY OF THE INVENTION

The primary object of the present invention is to provide a heater which is prevented by a temperature detecting element, from being nonuniformly heated and an image heating apparatus comprising such a heater.

Another object of the present invention is to provide a heater, on the substrate of which a plurality of resistive member and a plurality of temperature detecting elements are disposed, wherein a first portion of at least one resistive member, which corresponds to the location of the temperature detecting element, has a resistance value higher than that of a second portion of the same resistive member, and an image heating apparatus comprising such a heater.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Figure 1:
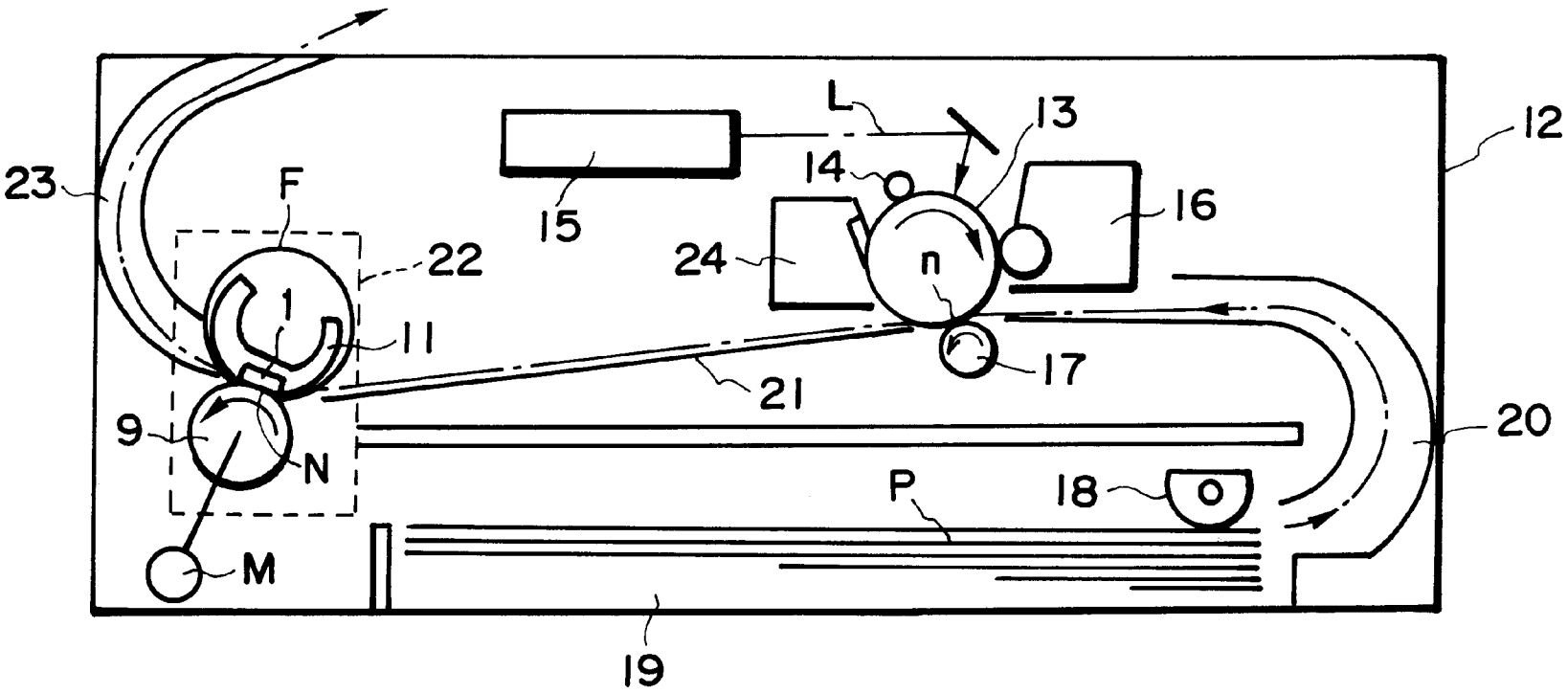
FIG. 1 is a schematic section of an image forming apparatus to which the present invention is applicable.

FIG. 1 is a schematic section of an image forming apparatus, and depicts the structure thereof. The image forming apparatuses in the following embodiments are laser beam printers employing a transfer type electrophotographic process.

A reference numeral 12 designates an apparatus housing, and a reference numeral 13 designates an electrophotographic photosensitive drum as an image bearing member which is rotatively driven in the clockwise direction indicated by an arrow mark, at a predetermined velocity (process speed).

As the photosensitive drum 13 is rotatively driven, it is uniformly charged to a predetermined polarity and a predetermined potential level by a charging roller 14 through a primary charging process. The uniformly charged surface of the photosensitive drum 13 is exposed to a laser beam L projected from a laser beam scanner which modulates the laser beam L with sequential digital signals which carry the image data of a target image. As a result, an electrostatic latent image corresponding to the image data of the target image is formed on the peripheral surface of the photosensitive member 15.

The latent image is developed as a toner image by a developing apparatus 16, and the toner image is sent to a transfer nip n formed between the photosensitive drum 13 and a transfer roller 17.

Meanwhile, a recording material P (transfer material) held in a sheet feeder cassette 19 is fed out one by one by a sheet feeder roller 18, and is sent to the transfer nip n through a sheet path 20 with predetermined timing. In the transfer nip n, an electric field having a polarity reverse to the toner is applied to the recording material P from the back side of the recording material P by the transfer roller 17. As a result, the toner image on the photosensitive drum 13 is transferred onto the surface of the recording material P.

After passing through the transfer nip n while receiving the toner image, the recording material P is separated from the photosensitive drum 13, and is guided into the next apparatus, that is, a fixing apparatus 22 as a heating apparatus, by a conveying guide 21. In the fixing apparatus 22, the toner image is thermally fixed to the recording material P, and then, the recording material P is discharged from the image forming apparatus through a sheet path 23.

After the toner image transfer, the surface of the photosensitive drum 13, which was facing the recording material P, is cleaned by a cleaning apparatus to be repeatedly subjected to image formation.

Figure 2:
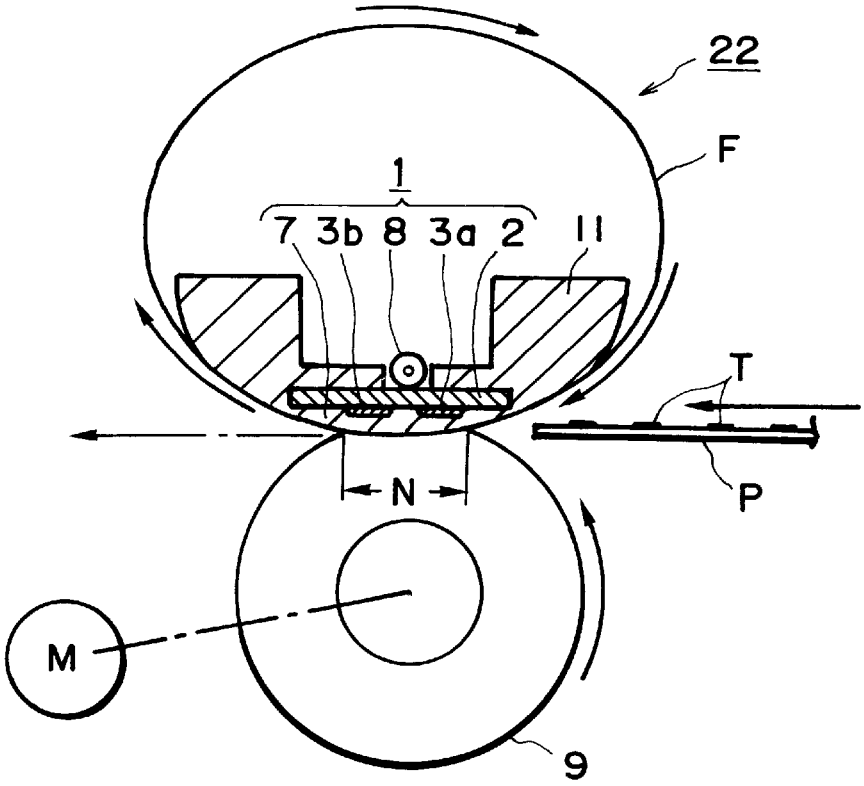
FIG. 2 is a schematic section of a fixing apparatus.
Figure 20A:
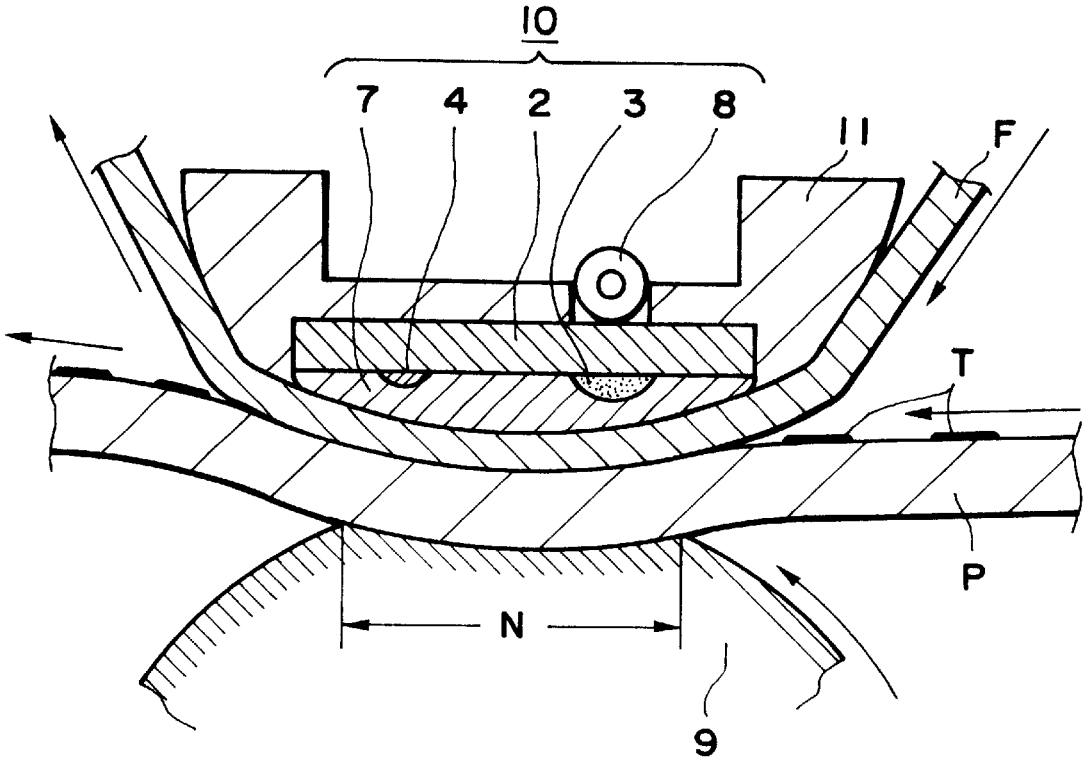
Figure 20B:
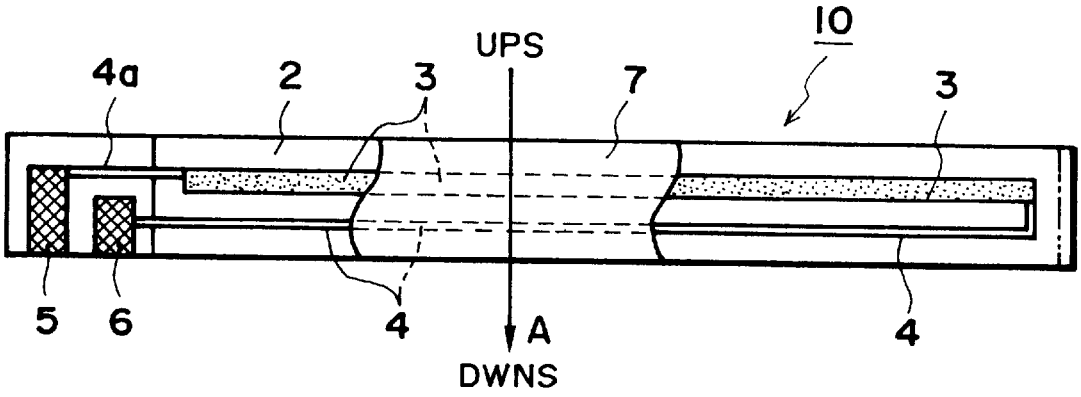

FIG. 2 is a schematic section of the fixing apparatus 22 in this embodiment, and depicts the structure of the fixing apparatus 22. This fixing apparatus 22 is constituted of a film heating type heating apparatus in which a tensionless film is driven by a pressing roller. The structural members or portions in this embodiment, which are common to the apparatus illustrated in FIG. 20 are designated with common symbols to avoid repetition of the same descriptions.

A reference numeral 1 designates a heating member, the structure of which will be described later in detail. The heating member 1 is fixed to the downward facing surface of a heating member holder 11 in such a manner that the front side of the heating member 1 faces downward. The cylindrical (endless) heat resistant film F (film composed by coating a base film of polyimide or the like with separative, heat resistant resin such as PFA or PTF) is loosely fitted around the heating member holder 11 fitted with the heating member 1, being pressed upon the heating member 1 by a pressing roller 9 (back-up member) with a predetermined pressure. As the pressing roller 9 presses on the heating member 1, with the interposition of the film F between the heating member 1 and the pressing roller 9, a heating nip N is formed at the contact point between the two.

The pressing roller 9 is rotatively driven in the clockwise direction indicated by an arrow mark, by a driving means M. The driving force from the pressing roller 9 is transmitted to the film F by the friction between the pressing roller 9 and the outwardly facing surface of the film F, whereby the cylindrical (endless) film F is rotated in the clockwise direction indicated by an arrow mark, around the heating member holder 11 fitted with the heating member 1.

A recording material P, which is carrying an unfixed toner image T, is introduced into the heating nip N, between the film F and the pressing roller 9, with the film F being rotated by the pressing roller 9, and the heating member 1 having reached a predetermined temperature after having been supplied with power. As the recording material F carrying the unfixed toner image T passes through the heating nip N together with the film F, being flatly in contact with the film F, the heat from the heating member 1 is transmitted to the recording material P through the film F. As a result, the unfixed under image T is thermally fixed to the surface of the recording material P. After passing through the heating nip N, the recording material P is separated from the surface of the film F due to the curvature of the cylindrical (endless) film F, and is conveyed further.

Figure 3:
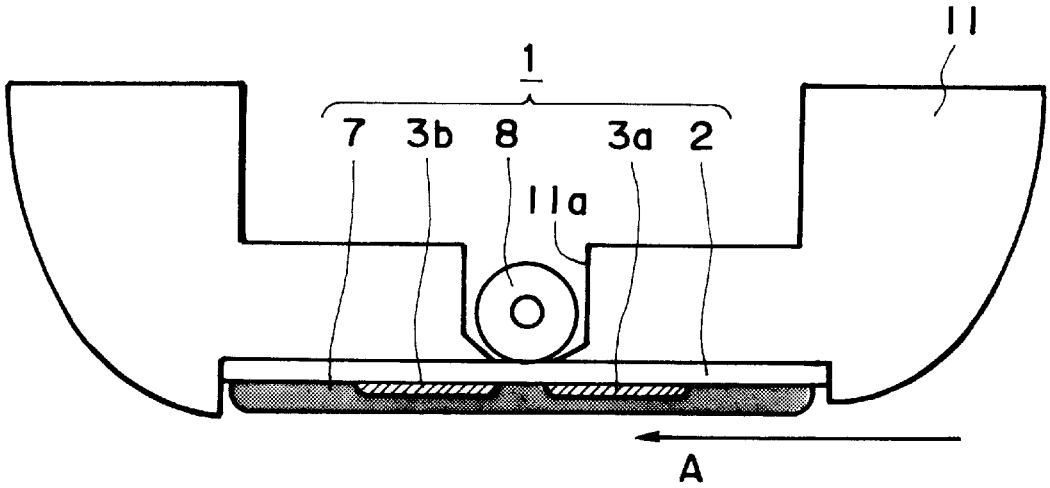
FIG. 3 is an enlarged section of the adjacencies of a heating member.
Figure 4:
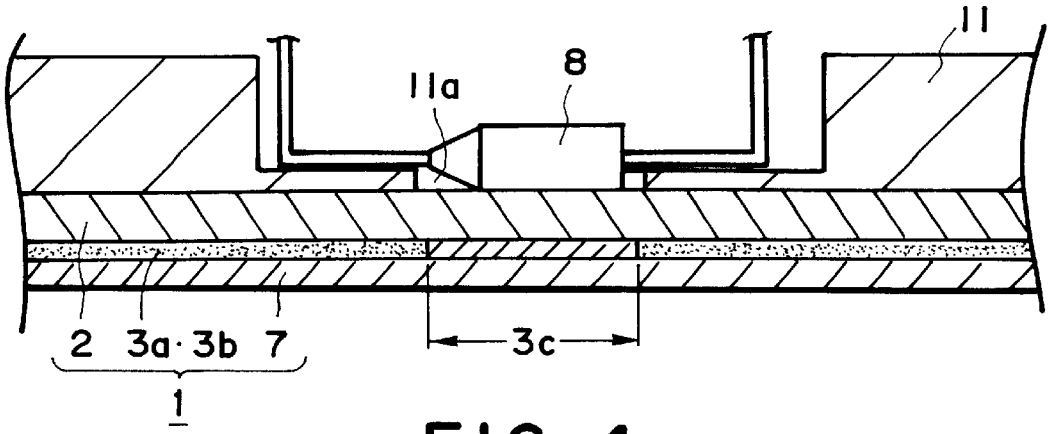
FIG. 4 is an enlarged schematic section of the adjacencies of the heating member as seen from the direction in which a film is moved.
Figure 5:
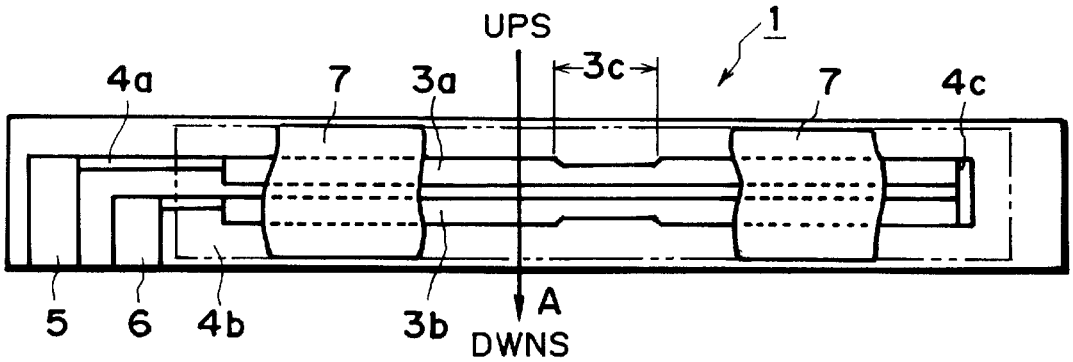
FIG. 5 is a plan view of the heating member.

FIG. 3 is an enlarged schematic section of the essential portion of the heating member 1; FIG. 4, a schematic vertical section of the same; and FIG. 5 is a partially cutaway plan of the heating member 1. In these drawings, the structural members or portions which are common to the heating member 10 illustrated in FIG. 20 are designated with common referential symbols to avoid repetition of the same descriptions.

Referring mainly to FIG. 5, the heating member 1 in this embodiment comprises an electrically insulative ceramic heater substrate 2, two strips (first and second) of patterned heat generating resistors 3*a* and 3*b*, and a film F. The longitudinal direction of the heater substrate 2 is perpendicular to a direction A in which the recording material P is conveyed. The first and second patterned heat generating resistors 3*a* and 3*b* are disposed on the front surface of the rectangular ceramic substrate 2, extending in the longitudinal direction of the substrate 2, substantially in parallel to each other. They are formed in the following manner. Electrically resistive paste composed by mixing metallic particles such as silver/palladium particles with glass paste is deposited on the ceramic substrate 2 to a predetermined thickness in a predetermined long and narrow pattern using a printing method, and then, is baked at approximately 800° C.

Two patterned power supply electrodes 5 and 6 are disposed side by side at one of the longitudinal ends of the ceramic substrate 2 in the same manner as those of the heating member 10 illustrated in FIG. 20.

One of the longitudinal ends of the first patterned heat generating resistor 3*a* is electrically connected to the patterned power supply electrode 5 through a patterned conductive material 4*a*, and one of longitudinal ends of the patterned second heat generating resistor 3*b* is electrically connected to the patterned power supply electrode 6 through a patterned conductive material 4*b*, on the same side as the first patterned heat generating resistor 3*a*. The opposite ends of the first and second patterned heat generating resistors 3*a* and 3*b* are electrically connected to each other by a patterned conductive material 4*c*.

The patterned conductive materials 4*a* and 4*b*, and the patterned power supply electrodes 5 and 6, are all formed in the following manner; paste of electrically conductive material such as Ag is deposited in a predetermined pattern on the surface of the ceramic substrate 2 by screen printing or the like, and then, is baked.

The first and second patterned heat generating resistors 3*a* and 3*b*, which are substantially parallel to each other, constitute a current path through which electrical current flows in the longitudinal direction of the ceramic substrate 2 between the patterned power supply electrodes 5 and 6 disposed at one end of the ceramic substrate 2. The reference numeral 7 designates a surface protection layer.

A safety element 8 in this embodiment, which is a temperature detecting element, is a thermal fuse. It is disposed in contact with the back surface of the heater substrate 2, that is, the back surface of the heating member 1, through the opening 11*a* provided in the heating member holder 11. As seen from above, the center of the contact between the safety element 8 and the heater substrate 2 is roughly aligned with the centers of the first and second patterned heat generating resistors 3*a* and 3*b*.

As electrical power is supplied through the patterned power supply electrodes 5 and 6 from an unillustrated power supply circuit., the first and second patterned heat generating resistors 3*a* and 3*b,* which constitute parts of the circuit through which current flows, generate heat across their entire lengths, increasing the temperature of the heating member 1. The increased temperature is detected by an unillustrated temperature detecting element, and the detected temperature is fed to an unillustrated temperature controlling circuit to control the power supply, so that the temperature of the heating member 1 is maintained at a predetermined level.

The turning section between the first and second patterned heat generating resistors 3*a* and 3*b* is constituted of a patterned conductive material 4*c* to reduce the electrical resistance of the turning section, so that this section is prevented from generating heat.

In this embodiment, the first and second patterned heat generating resistors 3*a* and 3*b,* which constitute the entering and returning current paths, respectively, generate substantially the same amount of heat.

With the above arrangement, the amounts of heat generated on the current entering side and current returning side are approximately the same, preventing thermal expansion from becoming substantially different between the current entering side and the current returning side. Therefore, a problem such as cracking of the heating member 1 is prevented.

When the heating member 1 comprises two strips of patterned heat generating resistors 3*a* and 3*b* (current entering path and current returning path), it can expose an object to be heated, which is conveyed through the heating nip N in the widthwise direction of the heating member 1, to higher temperature for longer duration than the heating member illustrated in FIG. 20, and also, the heating area becomes larger. Therefore, heating efficiency is increased; in a fixing apparatus, desirable fixing performance can be realized with the use of a smaller heating member. In other words, according to this embodiment, it is possible to construct such a fixing apparatus that can display satisfactory fixing performance and reliability high enough for an image forming apparatus which requires a higher standard in speed and efficiency.

Figure 6:
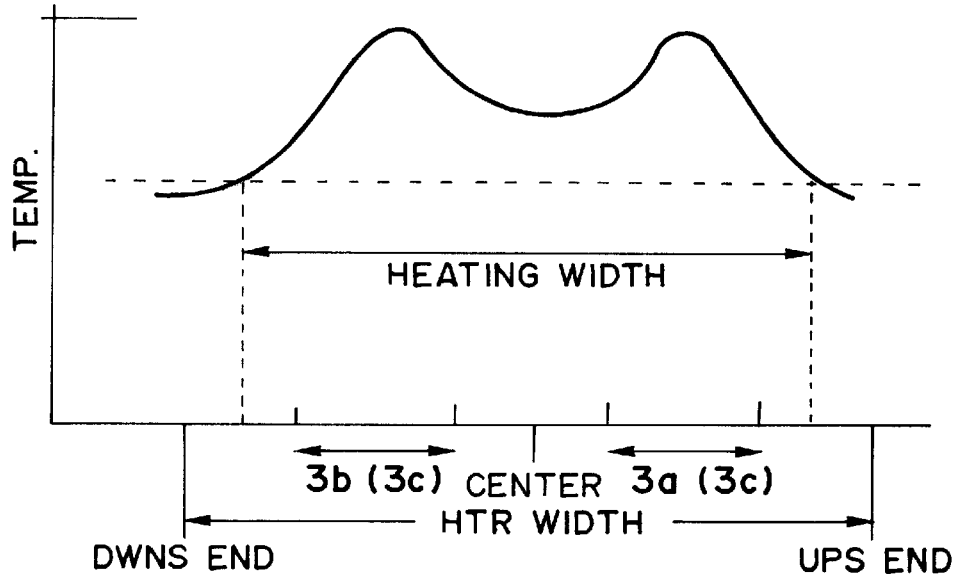
FIG. 6 is a graph depicting the heat distribution of the heating member.

When the thermal capacity of the safety element 8 is larger than that of the heating member holder 11, the temperature of the heating member 1 is locally reduced; the temperature at the contact area between the two becomes lower than the rest. In this embodiment, in order to prevent the fixing performance deterioration caused by this local low temperature area, the widths of the first and second heat generating resistors 3*a* and 3*b* are narrowed across the portion (first portion) which corresponds to the surface area in contact with the safety element 8. A reference numeral 3*c* designates the narrow portions of the heat generating resistors 3*a* and 3*b*. FIG. 6 is a graph showing the widthwise temperature distribution of the heating member 1, across the portion with the narrow heat generating resistor strips. The temperature distribution shows two peaks having substantially the same height, one at the current entering path and the other at the current returning path. The region in which the beat generating resistors 3*a* and 3*b* are not narrowed will be called a second portion.

In other words, in order to compensate for the thermal capacity difference between the safety element 8 and the heating member holder 11 so that the deterioration of fixing performance caused by the local low temperature area created in the portion which corresponds to the heating member surface in contact with the safety element 8, an arrangement is made to cause the heat generating resistors 3*a* and 3*b* of the heating member 1 to generate more heat across the portion which corresponds to the heating member surface in contact with the safety element 8. More specifically, as the width of the first and second heat generating resistors 3*a* and 3*b* is narrowed by an appropriate amount across the portion 3*c* which corresponds to the heating member surface in contact with the safety element 8, the resistance of this portion 3*c* is increased. The portion 3*c* with the increased resistance generates more heat than the other portion (second portion) of the heat generating resistor, compensating for the aforementioned thermal. capacity difference. As a result, the heating member 1 can heat an object substantially evenly in terms of the longitudinal direction of the heating member 1; in other words, the deterioration of fixing performance caused by the local low temperature area created on the heating member 1 corresponding to the contact area between the safety element 8 and the heating member 1, can be prevented.

Further, in this embodiment, the heating apparatus is structured so that the center of the temperature distribution coincides with the center of the heating member 1, and the safety element 8 is placed in contact with the central area of the heating member 1, enabling the safety element 8 to quickly respond to the out-of-control direction of the heating member 1.

Next, the second embodiment of the present invention will be described.

Figure 7:
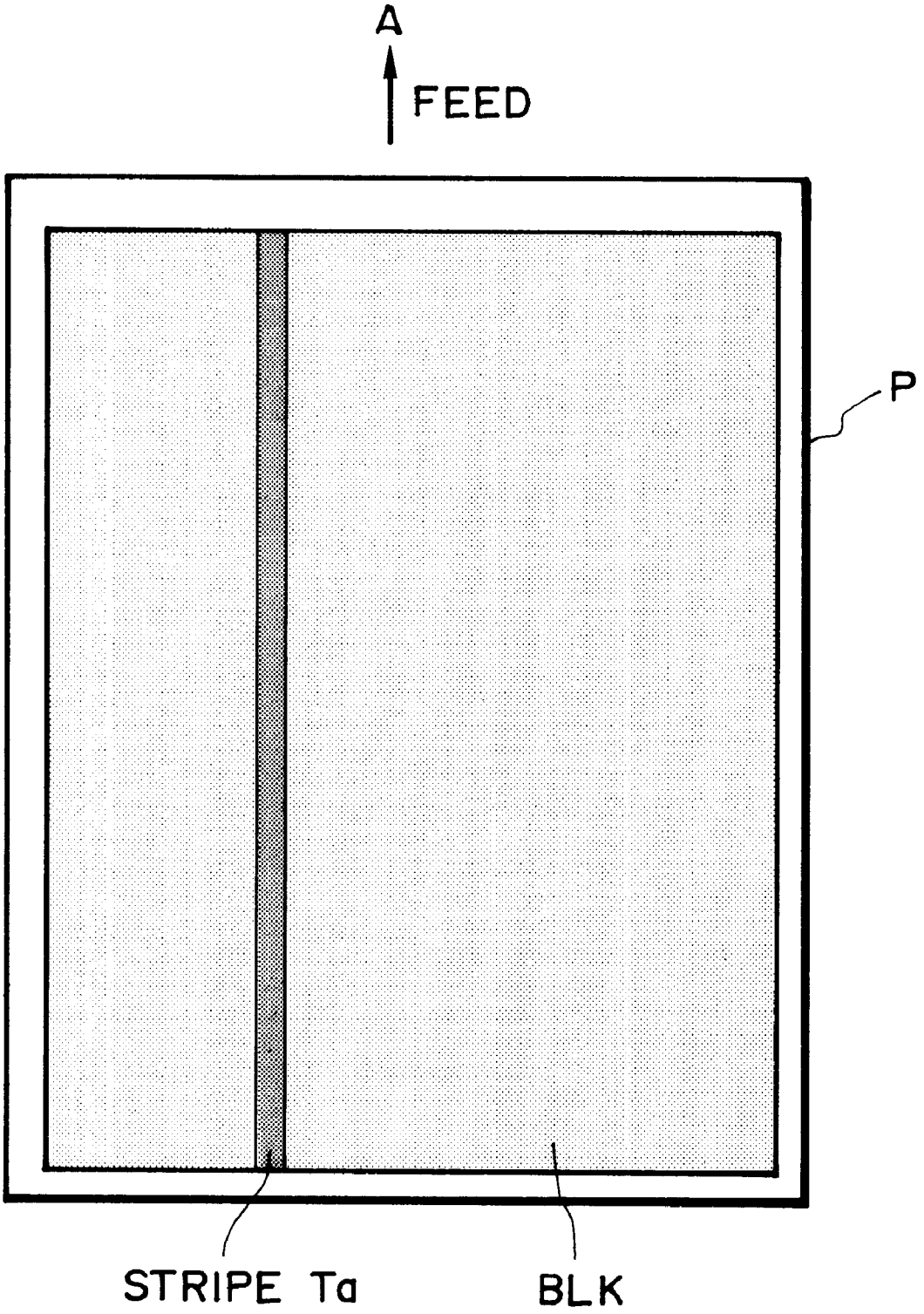
FIG. 7 is a plan view of a copy sheet, which depicts irregularity in glossiness.

As is evident from the description of the heating member 1 in the first embodiment, increasing the resistance of the heat generating resistor across its portion correspondent to the heating member surface area in contact with the safety element 8, is effective to prevent a local low temperature area from being created on the heating member across the heating member surface area in contact with the safety element 8. However, when the resistance of the heat generating resistor portion correspondent to the heating member surface portion in contact with the safety element 8 becomes excessively high, the toner on the recording material is overheated, becoming melted too much, across this portion. This sometimes results in toner offset correspondent to the narrowed portion of the heat generating resistor, or the appearance of a stripe Ta having glossiness different from other areas, in a solid black image or a halftone image, as shown in FIG. 7, which is not as extreme as toner offset.

This embodiment is to improve the heating apparatus in regard to the point described in the foregoing paragraph. More specifically, in the portion in which the safety element is placed in contact with the heating member, on the back side of the electrically insulative substrate, the amount of the heat which the heat generating resistor generates is rendered different between the upstream side and the downstream side, relative to the direction in which an object to be heated is conveyed. In other words, the patterns of the heat generating resistors are modified to render the widthwise heat distribution of the heating member different between the upstream and downstream sides, relative to the direction in which an object to be heated is conveyed. The safety element is disposed in contact with the electrically insulative portion of the heating member, on the side with higher heat output; positioning of the safety element is biased toward the higher side of the temperature distribution of the heating member in terms of the direction in which an object to be heated is conveyed.

Figure 8:
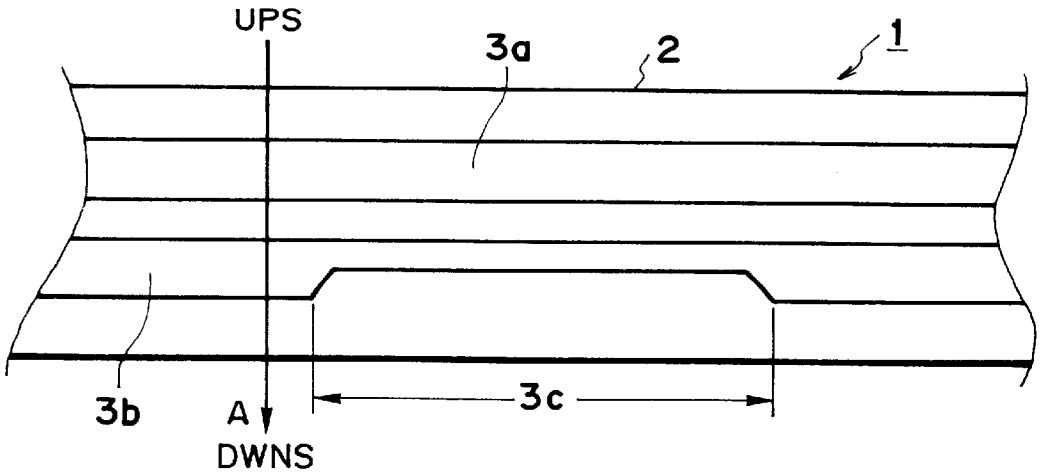
FIG. 8 is an enlarged view of a part of the heating member, in which a part of one of two patterned heat generating resistors is narrowed.
Figure 9:
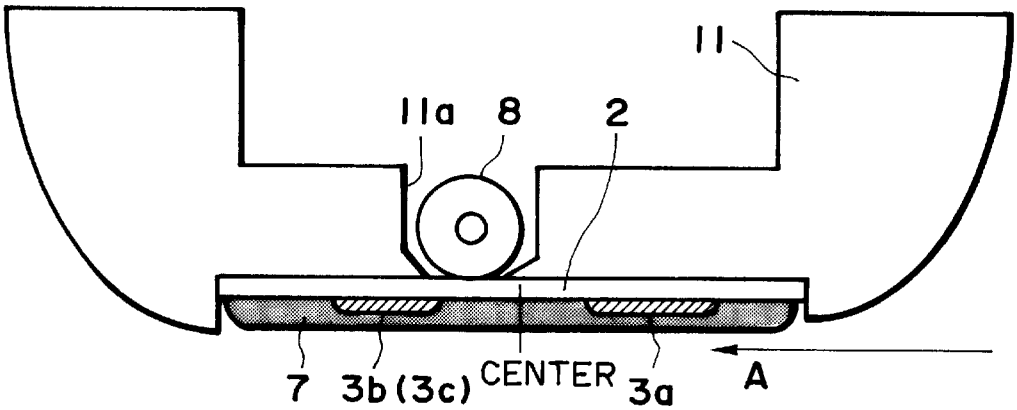
FIG. 9 is an enlarged section of the adjacencies of the heating member.

Referring to FIG. 8, in this embodiment, out of two (first and second) strips of the heat generating resistors 3*a* and 3*b* of the heating member 1, only the second heat generating resistor 3*b,* that is, the one on the downstream side, relative to the direction in which the recording material P, the object to be heated, is conveyed, is narrowed in the portion 3*c* which correspond to the heating member region in which the safety element is disposed in contact with the heating member 1. Referring to FIG. 9, the safety element 8 is disposed in contact with the back side of the heater substrate, being displaced from the center of the heating member, that is, closer to the second heat generating resistor 3*b* with the narrowed portion 3*c,* which is on the downstream side. The resistance of the narrow portion 3*c* of the second heat generating resistor 3*b* is increased by 10–50% per unit length compared to the resistance of the portion which is not narrowed.

Figure 10:
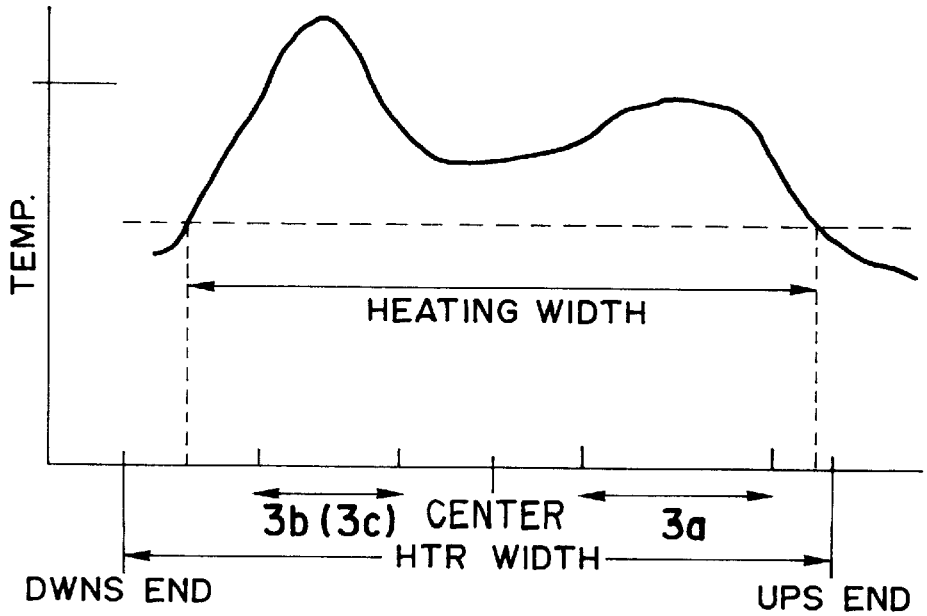
FIG. 10 is a graph depicting the widthwise heat distribution of the heating member.

Referring to FIG. 10, in comparison with the heating member 1 of the first embodiment 1 illustrated in FIG. 6, the heating member structure of this embodiment allows the heating member to generate more heat from the heat generating resistor on the downstream side, and also gives the heating member a wider heating width. In other words, since the safety element 8 is disposed closer to the second heat generating resistor 3*b* on the downstream side as shown in FIG. 9, the thermal capacity difference between the safety element 8 and the heating member 1 can be canceled, and since the heating member has a wider heating width, desirable fixing performance can be maintained.

In essence, in the case of the heating member 1 in the first embodiment (FIG. 5) in which in order to secure desirable fixing performance, the heat generating resistors 3*a* and 3*b* are inwardly narrowed across the portion 3*c* to provide higher temperature to eliminate the low temperature area, even a slight error in the narrowing of the heat generating resistor is liable to create a stripe Ta having glossiness different from the other region, in a fixed image, as shown in FIG. 7, or to cause toner offset. In this embodiment, improvement is made in regard to this point; a wider heating width is secured so that desirable fixing performance is secured by the provision of longer heating time.

Therefore, the error in the narrowing of the heat generating resistor does not manifest as a significant change in heating conditions. As a result, nonuniformity in glossiness or toner offset does not occur.

Figure 11:
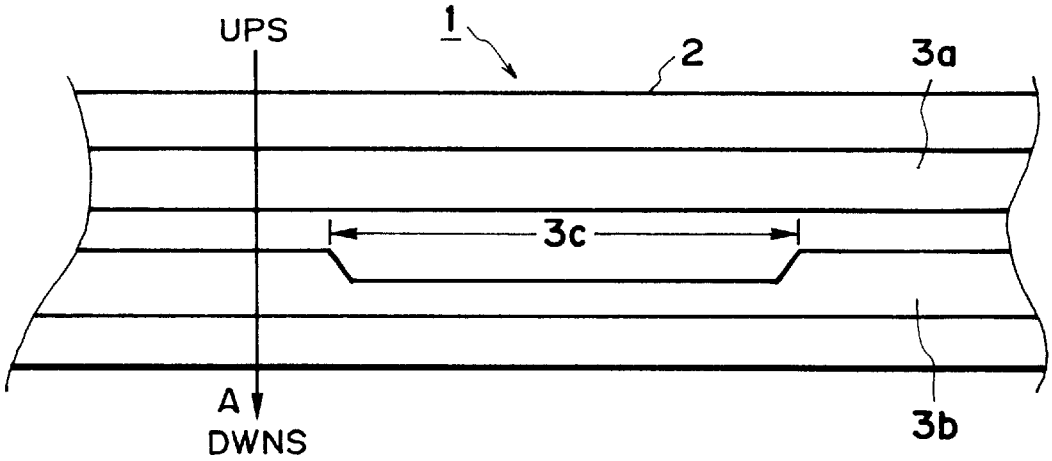
FIG. 11 is an enlarged view of a part of the heating member, in which a part of one of the two patterned heat generating resistors is narrowed.

In order to secure longer heating time, it is desirable to form a narrow portion 3*c* by narrowing the heat generating resistor 3*b* outwardly from the center of the heating member 1 as shown in FIG. 11. This is because such narrowing can provide a greater heating width, that is, a longer heating range in terms of the direction in which an object to be heated is conveyed. In this case, the heating width is uniform across the longitudinal direction of the heating member.

Figure 12:
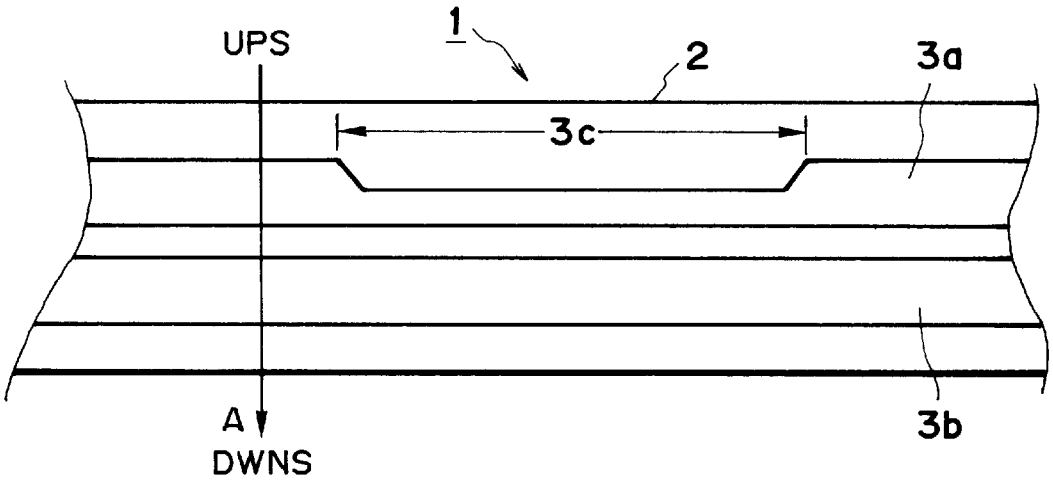
FIG. 12 is an enlarged view of the part of the heating member, in which a part of one of the two patterned heat generating resistors is narrowed.

Next, the third embodiment of the present invention will be described. In the case of the heating member 1 in the second embodiment, the narrow portion 3*c* is formed by narrowing the second heat generating resistor 3*b,* that is, the one on the downstream side relative to the direction in which an object to be heated is conveyed, across the portion in which the safety element 8 is disposed in contact with the heating member 1. In this embodiment, the narrow portion 3*c* is formed by narrowing the first heat generating resistor 3*a,* that is, the one on the upstream side relative to the direction in which an object to be heated is conveyed, across the region in which the safety element 8 is disposed in contact with the heating member 1, as shown in FIG. 12.

In this embodiment, the second heat generating resistor 3*b,* that is, the one on the downstream side, is not provided with a narrowed portion 3*c*. Therefore, the temperature of the recording material P at the time when it exits from the heating nip N is equalized between the portion correspondent to the narrow portion 3*c* and the portion correspondent to the unmodified portion, In other words, immediately before the recording material P exits from the heating nip N, it is heated to the saturation temperature (which does not cause toner offset nor fixation failure), that is, the heating limit, of the heat generating resistor 3*b* on the downstream size. As a result, difference in glossiness does not occur between the portion correspondent to the narrow portion 3*c* and the unmodified portion.

Figure 13:
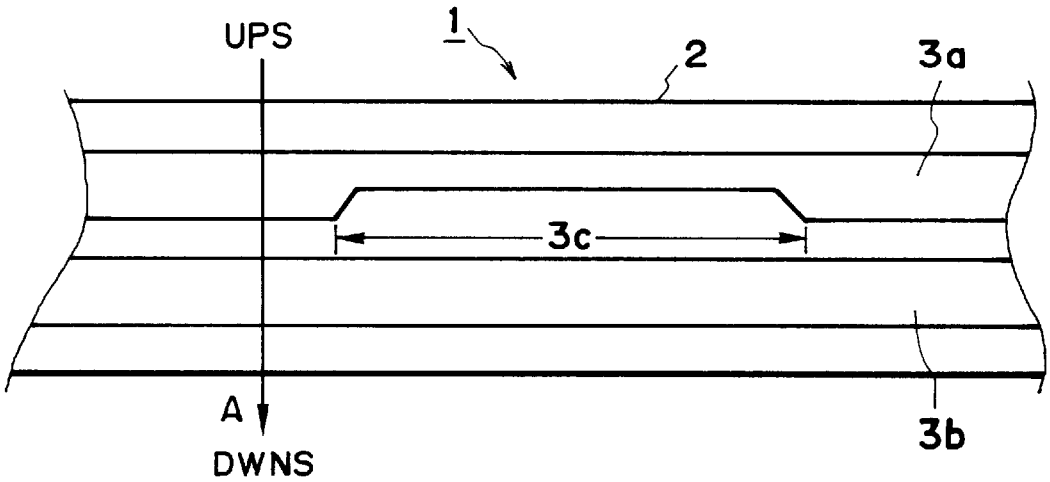
FIG. 13 is an enlarged view of the part of the heating member, in which a part of one of the two patterned heat generating resistors is narrowed.

Further, in order to increase heating distance in the direction in which an object to be heated is conveyed, it is desirable to form the narrow portion 3*c* by narrowing the first heat generating resistor 3*a,* the one on the upstream side relative to the direction in which an object to be heated is conveyed, outwardly from the center line of the heating member 1, as shown in FIG. 13. This modification can increase the heating width. Also, it can create a large temperature difference adjacent to the entrance side of the heating nip N without narrowing the portion 3*c* excessively. Therefore, beating efficiency is improved, and the improved heating efficiency secures desirable fixing performance.

Also in the case of this embodiment, in the region of the heating member 1, in which the safety element is disposed in contact with the back side of the heater substrate 2, the amount of heat which the heat generating resistor generates is different between the upstream and downstream sides of the heating member 1, relative to the direction in which an object to be heated is conveyed, and the safety element is disposed in contact with the electrically insulative base, closer to the heat generating resistor with higher heat output. In other words, relative to the temperature distribution of the heating member in the direction in which an object to be heated is conveyed, the safety element is disposed on the side with the higher temperature.

Next, the fourth embodiment of the present invention will be described. In this embodiment, the heat generating resistors are patterned so that the portion of the front surface of the electrically insulative base member of the heating member, which corresponds to the portion of the back surface of the electrically insulative substrate of the heating member, with which the safety element is disposed in contact, becomes symmetrical, and the safety element disposed in contact with the back surface of the electrically insulative substrate of the heating member is given the same distance from the edges of the correspondent narrow portions relative to the direction in which an object to be heated is conveyed.

Figure 14:
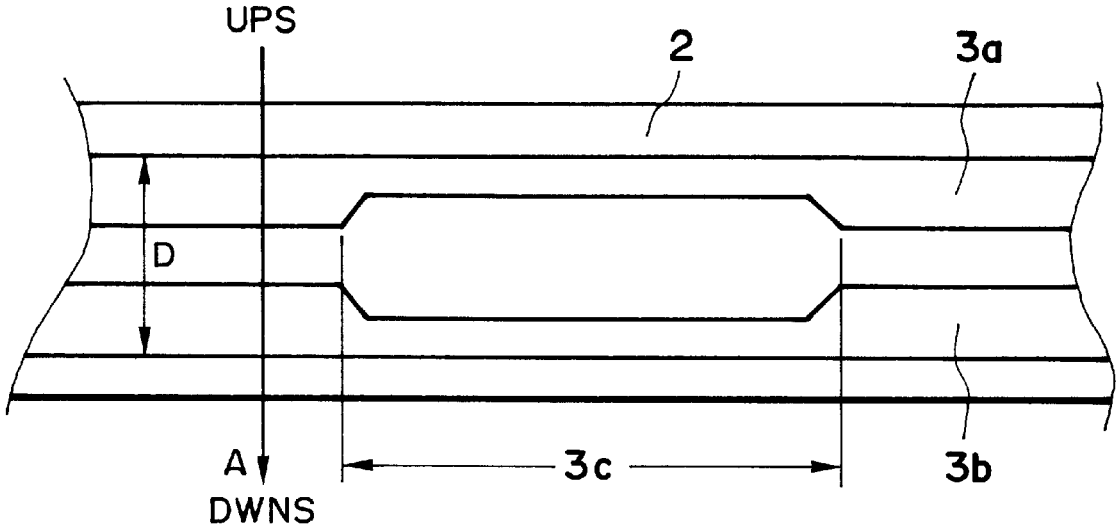
FIG. 14 is an enlarged view of the part of the heating member, in which a part of one of the two patterned heat generating resistors is narrowed.

In other words, in the second and third embodiments, only one of the two heat generating resistors, that is, the first heat generating resistor 3*b,* the one on the downstream side in the direction in which an object to be heated is conveyed, and the second heat generating resistor 3*a,* the one on the upstream side, respectively, is provided with the narrow portion 3*c*. However, in this embodiment, both the first and second heat generating resistors 3*a* and 3*b* are provided with the narrow portion 3*c* which is formed by narrowing the heat generating resistor outwardly from the longitudinal center line of the heating member, as shown in FIG. 14, and the safety element 8 is disposed in contact with the back surface of the heater substrate, between the two narrow portions 3*c;* and at the same time, at the substantial center of the heating member 1. A width D in the direction perpendicular to the longitudinal direction of the two heat generating resistors 3*a* and 3*b* is uniform across their entire length.

Figure 15:
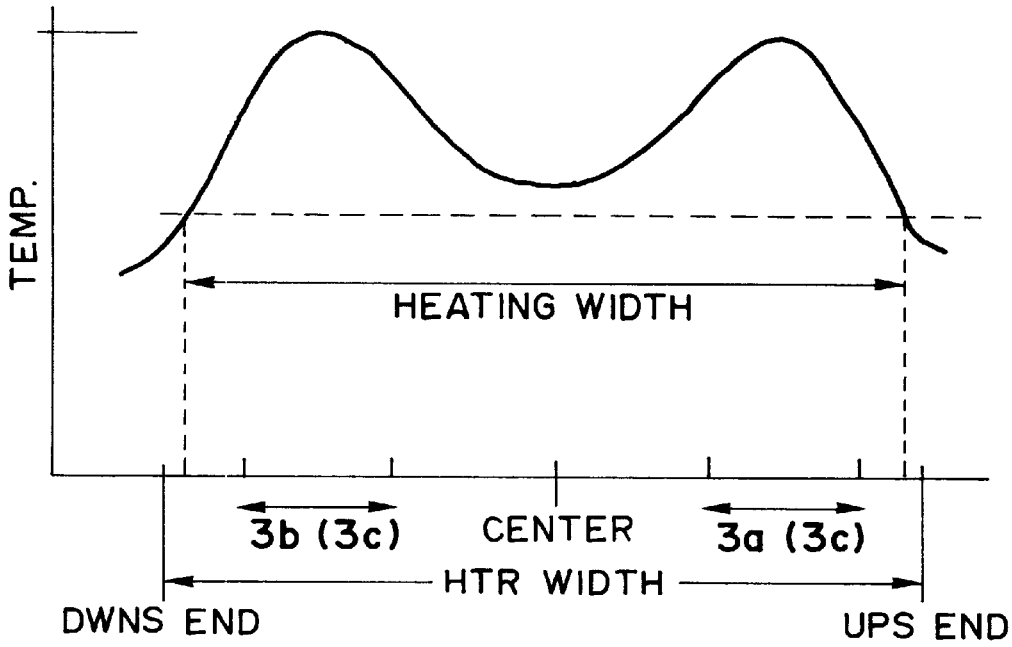
FIG. 15 is a graph depicting the widthwise heat distribution of the heating member.

Referring to FIG. 15, in the case of the heating member structure in this embodiment, the heating width is greater in comparison with the heating member 1 in the first embodiment illustrated in FIG. 6.

As the heating width becomes greater, compensation for the difference in thermal capacity between the safety element 8 and the heating member can be made not only by the modification of temperature distribution, but also by changing the heating time. Therefore, wider tolerance can be set for the resistance value of the narrow portion 3*c* to simplify the manufacturing. Also, wider tolerance can be set in controlling the safety element attachment accuracy, and the amount of unillustrated thermally conductive grease or adhesive used to improve the thermal conductivity between the safety element 8 and the heating member 1. Therefore, it becomes easier to produce a desirable heating apparatus.

Thus, it becomes possible to easily provide a desirable fixing apparatus which can prevent glossiness irregularity, or toner offset, while securing desirable fixing performance.

The width (heat output) by which the first and/or second heat generating resistors 3*a* and 3*b* are narrowed to form the narrow portion or portions 3*c* may be differentiated between the first and second heat generating resistors 3*a* and 3*b*.

Next, another embodiment of the present invention will be described. In this embodiment, the safety element is disposed in contact with the back surface of the electrically insulative base portion, on the spot which is directly opposite to the spot on the front surface of the same base portion, on which the heat generating resistor on the upstream side is disposed, and the amount of heat generated by the portion of the heat generating resistor on the upstream side, which corresponds to the safety element, is increased while increasing the length of the current path in this portion of the heat generating resistor. In other words, the pattern of the heat generating resistor is modified to increase the heat output as well as the heating width.

Figure 16A:
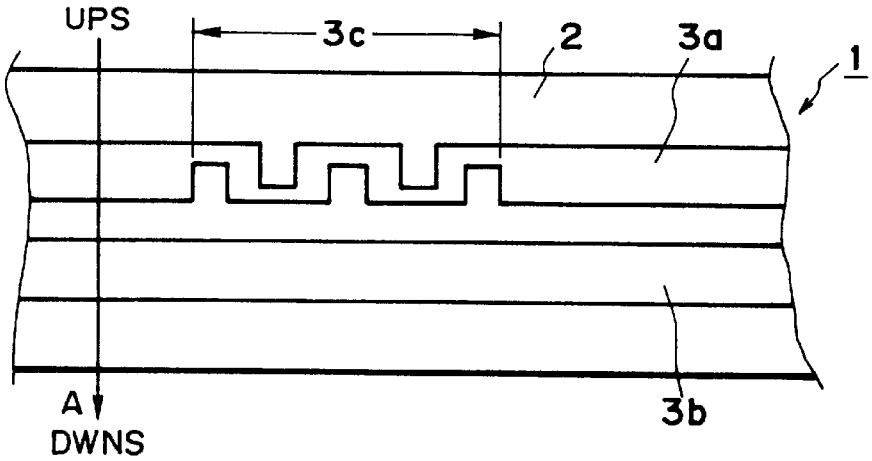
FIG. 16, which includes 16(*a*), (*b*) and (*c*), is an enlarged view of the part of the heating member, in which a part of one the two patterned heat generating resistors is narrowed
Figure 16B:
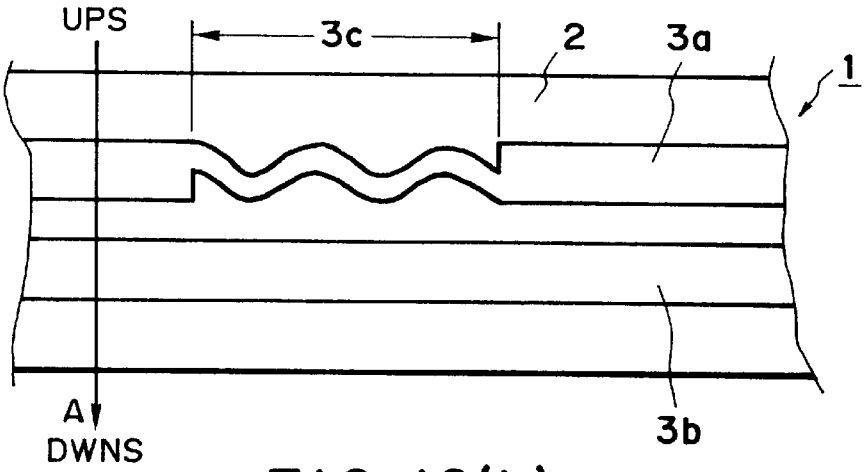
Figure 16C:
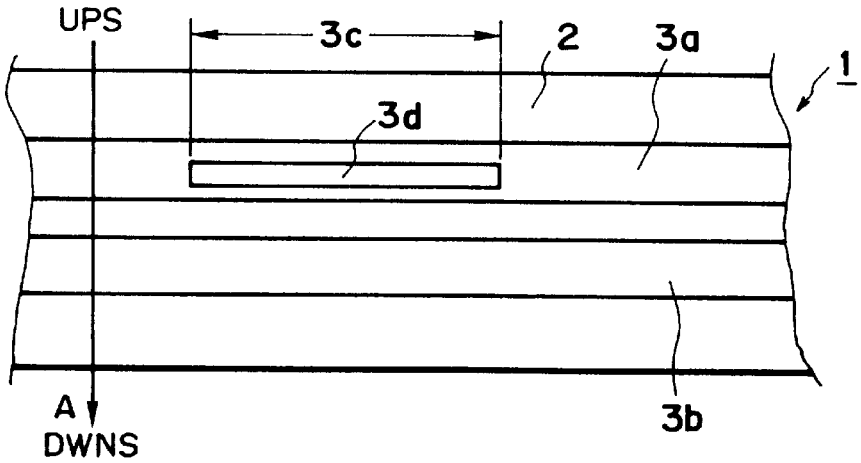

More specifically, in the first to fourth embodiments, the heat generating resistor was simply narrowed across the predetermined portion to form the narrow portion 3*c*. In this embodiment, how ever, the narrow portion 3*c* is given a zigzag (like the contour of the top edge of a crown rim) pattern as shown in FIG. 16(*a*).

With this arrangement, not only can the resistance value of the narrow portion 3*c* of the heat generating resistor be increased, but also, the temperature distribution in the direction of the heating width can be smoothed.

Therefore, it is possible to more easily balance the fixing performance against the toner offset or glossiness irregularity.

As for the pattern of the narrow portion 3*c,* it is unnecessary to limit it to the zigzag pattern. For example, it may be a wave pattern as illustrated in FIG. 16(*b*), or a slit 3*d* may be placed in the portion to be narrowed, instead of narrowing the portion, as illustrated in FIG. 16(*c*).

In this embodiment, the first heat generating resistor 3*a,* the one on the upstream side in the direction in which an object to be heated is conveyed is provided with the narrow portion 3*c*. However, the second heat generating resistor 3*b,* the one on the downstream side in the direction in which an object to be heated is conveyed, or both the first and second heat generating resistors 3*a* and 3*b,* may be provided with the narrow portion 3*c*.

Figure 17:
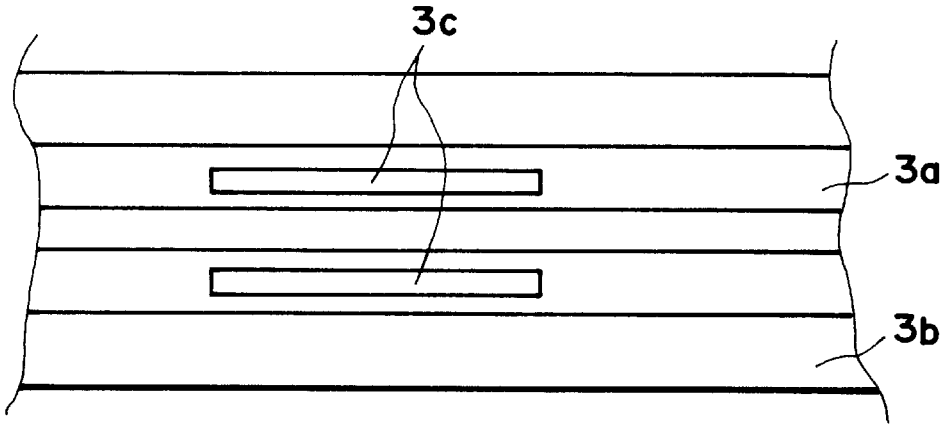
FIG. 17 is an enlarged view of the part of the heating member, in which a part of each of the two patterned heat generating resistors is narrowed.

An example in which the first and second heat generating resistors 3*a* and 3*b* are provided with the "narrow" (figuratively) portion 3*c* is illustrated in FIG. 17. FIG. 17 shows the pattern of the "narrow" portion, in which a slit 3*c* is placed in the portion equivalent to the narrow portion 3*c* in the preceding embodiments. This slit 3*c* can be formed by filling the meshes of a printing screen.

Figure 18:
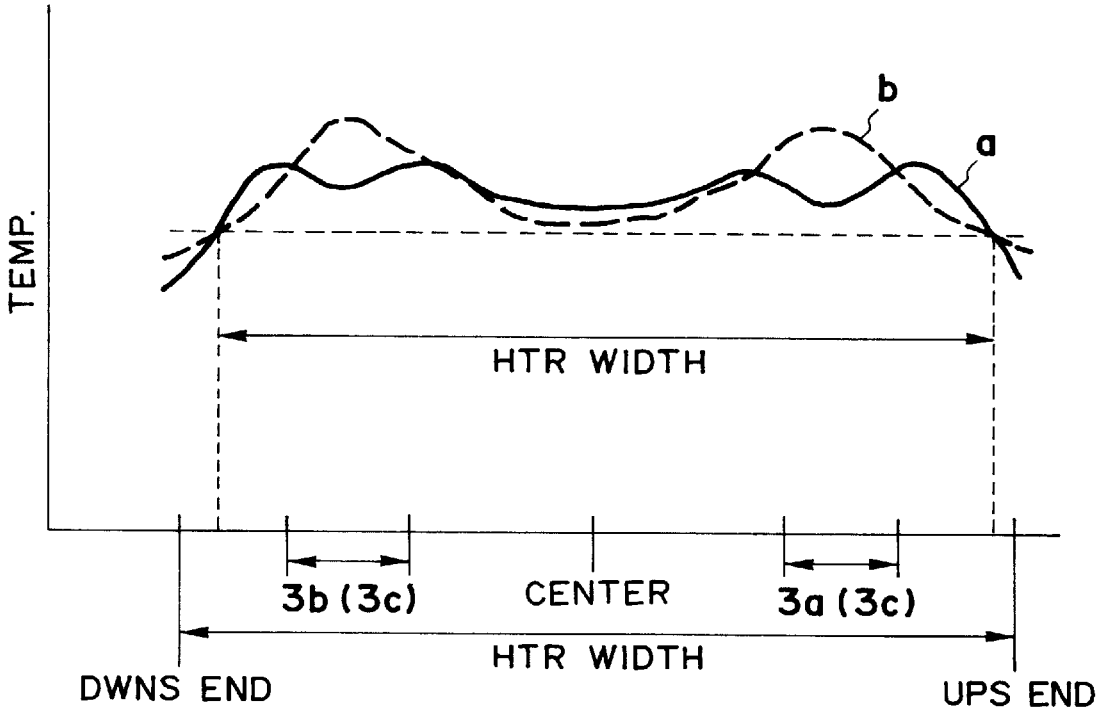
FIG. 18 is a graph depicting the widthwise heat distribution of the heating member.

FIG. 18 shows the heat distribution for the above described heat generating resistor pattern. The solid line a represents the temperature distribution for a heating member comprising the two strips of heat generating resistors with "narrow" portion, and the broken line b represents the temperature distribution for a heating member comprising two stripe of unmodified heat generating resistors.

As is evident from the graph, the temperature distribution pattern for the "narrow" portion has two peaks, one toward the center of the heating member and the other toward the edge, whereas their height is less than the unmodified portion of the heat generating resistor. This occurs because the theoretical peak for the "narrow" sub-strip portion of the heat generating resistor is higher than is shown in FIG. 18, but in an actual situation in which a heating member is assembled into a heating unit, the heat generated by the "narrow" sub-strip portion is robbed by a stay and a pressing roller.

As a result, the portion of the heating member, which corresponds to a thermal fuse, can provide a wider heating range with lower temperature, to secure desirable fixing performance while producing an image which does not suffer from irregularity is glossiness.

Next, a typical fixing apparatus to which the present invention is applicable will be described.

Figure 19A:
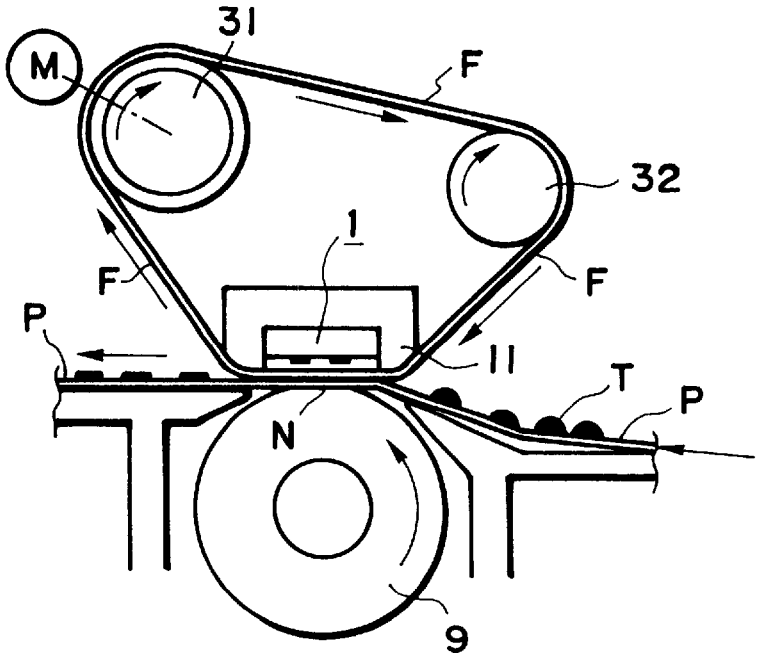
FIG. 19, which includes 19(*a*), (*b*) and (*c*), is a schematic section of another fixing apparatus to which the present invention is applicable, FIG. 20(*a*) is an enlarged section of the adjacencies of the heating member, and FIG. 20(*b*) is a plan view of the heating member.
Figure 19B:
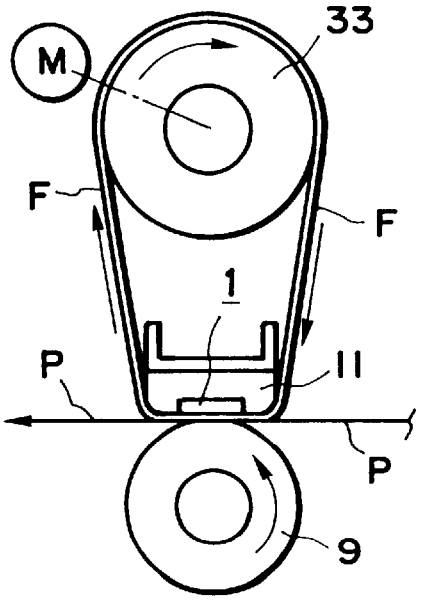
Figure 19C:
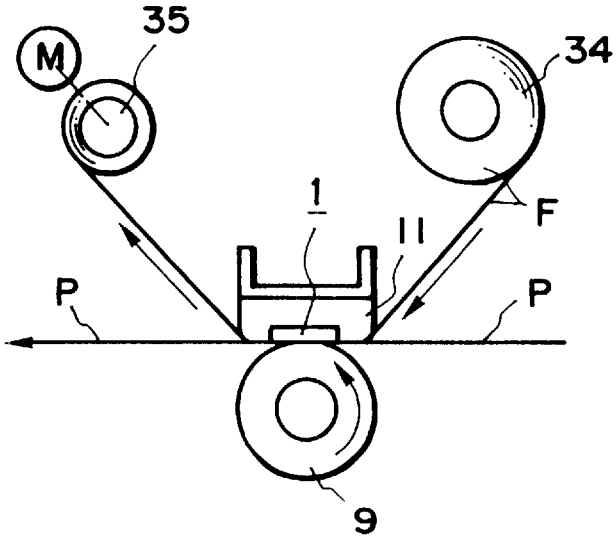

FIGS. 19(*a*), 19(*b*) and 19(*c*) are schematic sections of various film heating type heating apparatuses.

In the case of the heating apparatus illustrated in FIG. 19(*a*), a heat resistant endless film F is stretched around three members, that is, a first film suspension roller 31, a second film suspension roller 32, and a heating member 1, which are parallel to each other. A pressure roller 9 is pressed on the heating member 1, with the interposition of the endless film F between the pressing roller 9 and the heating member 1, and the heat resistant endless film F is rotatively driven by the film suspension roller 31 or the pressing roller 9 which doubles as a film driving roller. When the first film suspension roller 31 is used as the driving roller, the pressing roller 9 follows the rotation of the film F.

In the case of the heating apparatus illustrated in FIG. 19(*b*), a heat resistant endless film F is stretched around two members, that is a heating member 1 and a film suspension roller 33. A pressing roller 9 is pressed on the heating member 1, with the interposition of the film F between the pressing roller 9 and the heating member 1. The heat resistant endless film F is rotatively driven by the film suspension roller 33 or the pressing roller 9 which functions as a film driving roller. When the film suspension roller 33 is used as the driving roller, the pressing roller 9 follows the film F.

In the case of the heating apparatus illustrated in FIG. 19(*c*), a heat resistant film F is not in the form of an endless belt, and instead, is in the form of a long strip. This strip of heat resistant film F is rolled around a shaft 34, a delivery shaft, and is stretched to a shaft 35, a winding shaft, by way of a heating member 1, with the film F being pressed on the heating member 1 by a pressing roller 9. It is moved toward the winding shaft 35. The pressing roller 9 may be used as a film driving roller.

As for the pattern of the heat generating resistor, the number of the heat generating resistor strip does not need to be limited to two which was the case in the first and second embodiments; the number may be three or more.

When a pattern comprising a plurality of heat generating resistor strips is employed, the resistance value, material, width, thickness, or the like, may be differentiated among the strips.

The application of the heating member in accordance with the present invention is not limited to the heating apparatus (fixing apparatus) of a film heating type; it can be used as a heating member for a heating apparatus having a different structure.

Further, a heating apparatus in accordance with the present invention can be widely used not only as a fixing apparatus as those described in the preceding embodiments, but also as an apparatus for heating a printed recording material to improve its surface properties (glossiness or the like), an apparatus for temporarily fixing an image, a laminating apparatus, a drying apparatus, or the like.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

a heater;

a film having a surface in slidable contact with said heater and an opposite surface contactable to a recording material carrying an image;

wherein said film moves with the recording material, and the image on the recording material is heated by heat from said heater through said film;

wherein said heater includes an elongated base material and a plurality of resistors extended in a longitudinal direction on said base material, said resistors generating heat upon electric energy supply thereto; and a temperature detecting element, contacted to said base member, for detecting a temperature;

wherein at least one of the resistors has a first portion corresponding, in a longitudinal position, to said temperature detecting element and a second portion not corresponding to said temperature detecting element; and wherein a width of said first portion measured in a direction perpendicular to the longitudinal direction is smaller than a width of said second portion measured in a direction perpendicular to the longitudinal direction, wherein a gap between long sides of said resistors which are remotest relative to each other is constant along a length thereof.

2. An apparatus according to claim 1, wherein each of said resistors has a first portion disposed at a position corresponding in the longitudinal direction to said temperature detecting element and a second portion disposed in a position not corresponding thereto, and a width of said first portion measured in the longitudinal direction is smaller than that of said second portion.

3. An apparatus according to claim 1, wherein two of such resistors are provided, and only one of them has said first portion.

4. An apparatus according to claim 1, wherein two of such resistors are provided, and a gap between said the resistors, measured in the direction perpendicular to the longitudinal direction, is larger at said first portion than at said second portion.

5. An apparatus according to claim 4, wherein only one of said resistors has said first portion.

6. An apparatus according to claim 4, wherein each of said resistors has said first portion.

7. An apparatus according to claim 6, wherein said temperature detecting element is provided between said resistors.

8. An apparatus according to claim 1, wherein said first portion has a portion not having the resistor within the width thereof.

9. An apparatus according to claim 8, wherein two of such resistors are provided, and the portion not having said resistor is provided in each of said resistors.

10. An apparatus according to claim 8, wherein the portion not having said resistor is in the form of a slit.

11. An apparatus according to claim 1, wherein said temperature detecting element is provided on a side of said base member not having said resistor.

12. An apparatus according to claim 1, wherein said resistor generates heat upon electric energy supply thereto, and said temperature detecting element is a safety element for shutting-off of the electric energy supply to said resistor.

13. An apparatus according to claim 1, wherein two of such resistors are provided, and one longitudinal end portion of them is provided with an electroconductive portion for electrical connection of respective resistors, and the other longitudinal end portion is provided with an electrode portion.

14. An apparatus according to claim 1, wherein the longitudinal direction of said heater is perpendicular to a movement direction of said film.

15. An apparatus according to claim 1, further comprising a back-up member for forming a nip with said heater with said film therebetween, and the recording material is passed through the nip, by which the unfixed image is fixed.

16. A heater comprising:

an elongated base member;

a plurality of resistors provided on said base member and extended in a longitudinal direction of said base member, said resistors generating heat upon electric energy supply thereto;

wherein at least one of the resistors has a first portion corresponding, in a longitudinal position, to a temperature detecting element and a second portion not corresponding to said temperature detecting element; and wherein a width of said first portion measured in a direction perpendicular to the longitudinal direction is smaller than a width of said second portion measured in a direction perpendicular to the longitudinal direction, wherein a gap between long sides of said resistors which are remotest relative to each other is constant along a length thereof.

17. A heater according to claim 16, wherein each of said resistors has the first portion disposed at a position corresponding in the longitudinal direction to said temperature detecting element and a second portion not corresponding thereto, and a width of said first portion measured in the longitudinal direction is smaller than that of said second portion.

18. A heater according to claim 16, wherein two of such resistors are provided, and only one of them has said first portion.

19. A heater according to claim 16, wherein two of such resistors are provided, and a gap between said the resistors, measured in the direction perpendicular to the longitudinal direction, is larger at said first portion than at said second portion.

20. A heater according to claim 19, wherein only one of said resistors has said first portion.

21. A heater according to claim 19, wherein each of said resistors has said first portion.

22. A heater according to claim 21, wherein said temperature detecting element is provided between said resistors.

23. A heater according to claim 16, wherein said first portion has a zigzag configuration.

24. A heater according to claim 16, wherein said first portion has a portion not having the resistor within the width thereof.

25. A heater according to claim 24, wherein two of such resistors a provided, and the portion not having said resistor is provided in each of said resistors.

26. A heater according to claim 24, wherein the portion not having said resistor is in the form of a slit.

27. A heater according to claim 16, wherein said temperature detecting element is provided on a side of said base member not having said resistor.

28. A heater according to claim 16, wherein said resistor generates heat upon electric energy supply thereto, and said temperature detecting element is a safety element for shutting-off of the electric energy supply to said resistor.

29. A heater according to claim 16, wherein two of such resistors are provided, and one longitudinal end portion of them is provided with an electroconductive portion for electrical connection of respective resistors, and the other longitudinal end portion of each of them is provided with an electrode portion.

30. A heater comprising:

an elongated base member;

first and second resistors extended parallel with each other with a gap therebetween on and along said base member;

an electrode provided for each of said first and second resistors, wherein said first and second resistors generate heat upon electric energy supply thereto;

wherein said first resistor has a first high resistance portion having a resistance per unit length which is higher than a portion adjacent thereto, said second resistor has a second high resistance portion having a resistance per unit length which is higher than a portion adjacent thereto, and said first and second high resistance portions are provided at a same position in a longitudinal direction, wherein a distance between long sides of said resistors which are remotest relative to each other is constant along a length thereof.

31. A heater according to claim 30, wherein a width of each high resistance portion measured in a direction perpendicular to a longitudinal direction of said heater, is smaller than a width of the adjacent portion.

32. A heater according to claim 30, wherein an entire resistor comprising said first and second resistors has a uniform width, in the longitudinal direction.

33. A heater according to claim 32, wherein a distance between said first and second resistors at said high resistance portions is larger than a distance between them at the adjacent portion.

34. A heater according to claim 32, wherein each of said first and second resistors has a slit at said high resistance portion.

35. A heater according to claim 30, wherein said electrodes are provided only at one end portion of said base member, said heater further comprising a conducting portion for electric connection between said first and second resistors at the other end portion.

36. An image heating apparatus comprising:

a heater;

a film having a surface in slidable contact with said heater and an opposite surface contactable to a recording material carrying an image, wherein said film is movable with the recording material, and the image of the recording material is heated by heat from said heater through said film;

said heater comprising:

an elongated base member;

first and second resistors extended parallel with each other with a gap therebetween on and along said base member;

an electrode provided for each of said first and second resistors, wherein said first and second resistors generate heat upon electric energy supply thereto;

wherein said resistor has a first high resistance portion having a resistance per unit length which is higher than a portion adjacent thereto, said second resistor has a second high resistance portion having a resistance per unit length which is higher than a portion adjacent thereto, and said first and second high resistance portions are provided at a same position in a longitudinal direction, wherein a distance between long sides of said resistors which are remotest relative to each other is constant along a length thereof.

37. An apparatus according to claim 36, further comprising a temperature detecting element, contacted to said base member, for detecting a temperature, wherein said temperature detecting element is provided at the same position as the high resistance portions, in the longitudinal direction of said resistors.

38. An apparatus according to claim 37, wherein said temperature detecting element is a safety element for shutting electric energy supply to said resistor.

* * * * *

UNITED STATES PATENT AND TRADEMARK OFFICE

CERTIFICATE OF CORRECTION

PATENT NO. : 6,469,279 B1
DATED : October 22, 2002
INVENTOR(S) : Yasumasa Ohtsuka It is certified that error appears in the above-identified patent and that said Letters Patent is hereby corrected as shown below:

Column 1,
Line 15, “in” should read -- is --.

Column 2,
Line 42, “one ed” should read -- one end --.

Column 3,
Line 21, “P After” should read -- P. After --.

Column 4,
Line 37, “one” should read -- one of --.

Column 6,
Line 4, “F” should read -- P --.
Line 9, “under” should read -- toner --.

Column 8,
Line 4, “beat” should read -- heat --.
Line 55, “halftone” should read -- half-tone --.

Column 9,
Line 48, “point;” should read -- point, --.

Column 11,
Line 8, “3c;” should read -- 3c, --.

Column 12,
Line 21, “stripe” should read -- stripes --.

UNITED STATES PATENT AND TRADEMARK OFFICE

CERTIFICATE OF CORRECTION

PATENT NO. : 6,469,279 B1
DATED : October 22, 2002
INVENTOR(S) : Yasumasa Ohtsuka It is certified that error appears in the above-identified patent and that said Letters Patent is hereby corrected as shown below:

Column 13,
Line 18, “type; it” should read -- type. It --.

Signed and Sealed this

Eighteenth Day of March, 2003

JAMES E. ROGAN
*Director of the United States Patent and Trademark Office*